United States Patent [19]

Gaisser et al.

[11] 4,406,370

[45] Sep. 27, 1983

[54] ADDITIVE CONTAINERS FOR METAL CASTING

[75] Inventors: Gary T. Gaisser; Daniel P. Gregan, both of Brunswick, Ohio

[73] Assignee: Foseco International Limited, Birmingham, England

[21] Appl. No.: 244,156

[22] Filed: Mar. 16, 1981

[30] Foreign Application Priority Data

Mar. 29, 1980 [GB] United Kingdom ..... 8010701

[51] Int. Cl.[3] ..... B65D 83/00; B65D 85/00; B65D 75/42; B22D 7/12; B22D 27/00

[52] U.S. Cl. ..... 206/484; 164/55.1; 206/806; 206/219; 229/3.5 MF

[58] Field of Search ..... 206/484, 819, 219, 820, 206/806; 229/3.5 MF

[56] References Cited

U.S. PATENT DOCUMENTS 2,978,765 4/1961 Brown ..... 206/806
3,085,880 4/1963 Evans et al. ..... 229/3.5 MF
3,920,063 11/1975 Sasaki et al. ..... 206/819

FOREIGN PATENT DOCUMENTS 825087 12/1959 United Kingdom .
1492692 11/1977 United Kingdom .
2035163 6/1980 United Kingdom ..... 206/484
667325 6/1979 U.S.S.R. ..... 206/484

*Primary Examiner*—William T. Dixson, Jr.
*Attorney, Agent, or Firm*—Cushman, Darby & Cushman

[57] ABSTRACT

A sealed container, for providing a particulate, metal-casting flux in a vessel e.g. ingot mould in which a metal e.g. steel is being cast, has walls comprising an inner layer of plastics material heat-sealed to seal the container and, secured to the inner layer, an outer layer of aluminium foil. A number of the containers may be joined together as a length. The container(s) may be suspended down the side of a mould and/or put on the base of the mould.

6 Claims, 3 Drawing Figures

FIG.1.
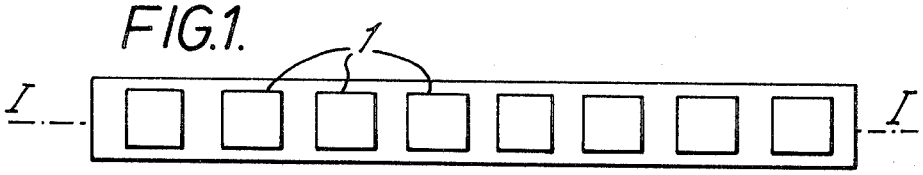
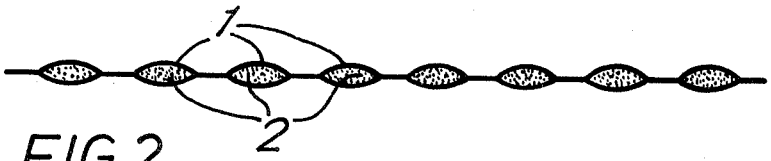
FIG.2.
FIG.3.
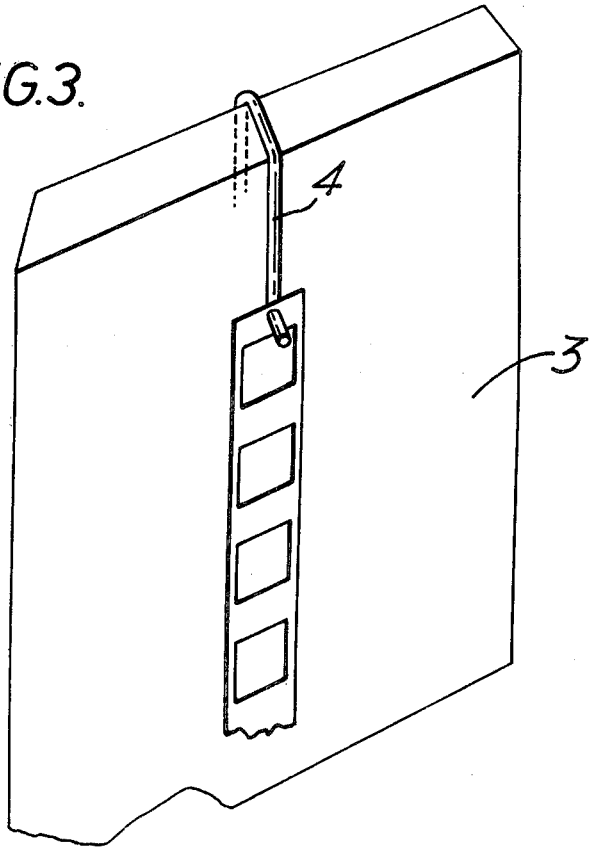

ADDITIVE CONTAINERS FOR METAL CASTING

The invention concerns containers of additives for use in the casting of metals, especially containers of fluxes for use in the casting of steel ingots.

In the casting of steel ingots, fluxes are used in order to improve the ingot surface and to reduce inclusions. It is generally desirable for the flux to be supplied gradually to the rising molten steel surface as the molten steel is teemed into the mould. Where the steel is introduced through the base of the mould, the desired gradual supply of the flux can be achieved by initially having a flux-containing board in the bottom of the mould, the board floating on the rising steel surface and gradually releasing flux.

In the case of ingots where the steel is teemed from the top of the mould, the use of a flux-containing board is unsuitable and instead it is usual for bags of powdery flux to be thrown on top of the rising steel surface in the mould at intervals during teeming. This method is not entirely satisfactory as it requires an operative to throw the bags of flux into the mould at intervals and the method gives variable results as it is dependent on the skill of the operative.

From British patent specification No. 825 087 it is known to suspend in an ingot mould, whilst the metal is being teemed, a chain of containers each containing an additive intended to set up a reaction in the metal. The containers are made of matter that is destructible by the molten metal or the heat radiated from it and the object is to achieve controlled release of the additive. However, the chains of containers and their manner of use have disadvantages: in some cases the containers and/or their means of connection are complicated, they all require special suspension means and would involve application difficulties and they lack reliability and adaptability to different specific purposes.

In British patent specification No. 1 492 692 there is described, for use in adding ferrosilicon powder to cast-iron melts in foundry moulds, a sachet formed from two layers of plastics material-coated paper heat-sealed together and containing a measured quantity of ferrosilicon powder. If an addition amounting to the contents of two or more sachets is desired, two or more connected sachets may be used. Whilst this proposal may be very suitable for its particular purpose, it would not be suitable for the very different purpose of achieving controlled addition of a flux during casting a steel ingot: the sachets would be destroyed too readily in use.

According to the present invention a sealed container, for providing a particulate, metal-casting flux in a vessel in which a metal is being cast, has walls comprising an inner layer of plastics material heat-sealed to seal the container and, secured to the inner layer, an outer layer of aluminium, or aluminium alloy, foil and contains a particulate, metal-casting flux. The container is destroyed on contact with a body of molten metal such as steel and the flux therby released. By suitably positioning one or more of the containers in the vessel, the release of a particular amount of flux at a particular stage in the casting process can be achieved.

It is greatly preferred to have a number of the containers joined together as a length. In casting a steel ingot a length of the containers may be suspended in the mould during teeming. Part of the length may rest on the base of the mould, thereby providing a convenient way of achieving the desirable result of supplying a larger amount of flux early in the teeming process than later during teeming. The lengths of containers can be used both in the case of indirect teeming i.e. through the base of the mould and in the case of direct teeming i.e. from the top of the mould, but are especially valuable in the latter case. In the case of indirect teeming, one or more containers of a length of the containers may be positioned at the base of the mould over the inlet for the molten steel to provide protection against the initial surge of the steel into the mould at the beginning of teeming and thus reduce the adverse effect that the initial surge may have. More than one length of containers can be used if desired. The length can be suspended down a side of the mould using a simple hanger engaging the top of the mould.

By hanging the containers against the side wall of a mould rather than throwing bags of flux into the mould, the risk of flux being trapped in the steel is reduced as mixing is less violent at the side of the mould cavity.

The fact that the innermost layer of the container is of heat-sealed plastics material makes the containers, and lengths of them, convenient to manufacture. For example, a length of aluminium foil having a heat-sealable plastics material coating may be folded along its length with the plastics material coating inwards and separate portions of flux inserted, using heat-sealing to provide separate but connected envelopes around each portion of flux and to seal together the long free edges of the original length of plastics material-coated aluminium foil.

The aluminium foil serves to prevent premature destruction of the containers whilst it is rapidly destroyed on contact with a body of molten steel. If the containers were of plastics material or paper alone there would be a serious risk of premature destruction as a result of stray droplets of steel or sparks striking a container before the level of molten steel in the mould reached that container. The resistance to destruction of the heat-sealable plastics material is negligible compared with that of the aluminium foil and thus the flux is promptly released once the desired destruction of the aluminium foil has occurred. In view of the reactivity of aluminium and its low melting point, compared for example with that of steel, it is surprising that the use of the aluminium foil layer does prevent premature destruction.

In addition to their separate merits, the heat-sealable plastics material layer and the aluminium foil layer mutually reinforce each other and they also provide a container which ensures that the flux does not absorb moisture. If desired, the strength of the containers can be further increased by providing an external layer e.g. of plastics material on the aluminium foil to protect the foil from damage during transit or handling. The materials of the containers are such that there is no risk of them resulting in contamination of the steel.

The aluminium of the containers has a further advantage in that it is an exothermically reactive material and thus enhances the exothermicity of exothermic fluxes. Furthermore, whilst some fluxes are exothermic, others are not and in the case of non-exothermic fluxes the exothermic properties of the aluminium of the containers are still valuable in that they reduce chilling of the molten steel by the flux and thereby help prevent flux becoming trapped in the teemed steel.

Preferably the material connecting the containers is the same as that of the containers themselves: this is convenient in making the lengths of containers e.g. in the manner described above. In any one length the containers may be of the same size and evenly spaced or they may be of different sizes and/or spaced in a predetermined non-uniform way. If desired, the composition of the flux in different containers of a length may differ, as may the amount of flux in the different containers.

The flux may be any particulate flux suitable for casting steel ingots. Preferably the flux contains a fluoride e.g. fluorspar, or other low melting point fluxing agent, e.g. sodium borate. The flux preferably also contains, in free or combined form, silica and an alkaline earth metal oxide e.g. lime. The flux may also contain other ingredients for specific functions e.g. an alkaline earth metal carbonate or exothermically reactive ingredients.

The invention includes a method of casting a steel ingot in which a length of containers according to the invention is suspended in the mould during teeming.

The invention is further described with reference to the diagrammatic drawings in which:

FIG. 1 is a plan of a length of containers in accordance with the invention;

FIG. 2 is a section along the line I—I in FIG. 2 and

FIG. 3 is a cut-away partial view of an ingot mould in which is suspended the length of containers of FIGS. 1 and 2.

Referring to FIGS. 1 and 2, the length of containers consists of a number of containers 1, each containing a powdery flux 2 for use in casting steel ingots. The containers are formed from two layers of aluminium foil having a plastics material coating, the plastics material-coated surfaces facing each other. The length of containers is formed by heat-sealing the two layers together except in those areas defining the containers themselves and the flux is put in suitable amounts in these areas before the heat-sealing is completed.

Referring now to FIG. 3, the length of containers is suspended in an ingot mould adjacent to a mould wall 3 by means of a hanger 4 engaging with the top of the mould.

On teeming steel into the mould from the top, any containers resting on the bottom of the mould are rapidly destroyed and the flux released and then, as teeming continues and the level of steel in the mould rises, successively higher containers adjacent the mould wall are destroyed and the flux released.

We claim:

1. A sealed container, for providing a particulate, metal-casting flux in a vessel in which a metal is being cast, said container having walls comprising an inner layer of plastics material heat-sealed to seal the container and, secured to the inner layer, an outer layer of aluminium-containing foil and said container containing a particulate, metal-casting flux.

2. A container according to claim 1 in which there is an external layer of plastics material on the layer of aluminium-containing foil.

3. A container according to claim 1 in which the flux is a flux suitable for use in the casting of steel ingots.

4. A container according to claim 3 in which the flux contains exothermically reactive ingredients.

5. A container according to claim 3 in which the flux comprises a low melting point fluxing agent, silica-containing matter and an alkaline earth metal oxide.

6. A length of containers joined together, each of the containers being a container according to claim 3.

* * * * *